United States Patent [19]

Braunschweig et al.

[11] Patent Number: 4,563,047

[45] Date of Patent: Jan. 7, 1986

[54] CHECK FILING CABINET

[75] Inventors: Peter M. Braunschweig, Orchard Park; Thomas J. Ruffles, Jr., Tonowanda, both of N.Y.

[73] Assignee: Astronics Corporation, Orchard Park, N.Y.

[21] Appl. No.: 520,984

[22] Filed: Aug. 8, 1983

[51] Int. Cl.[4] ..... A47B 17/00

[52] U.S. Cl. ..... 312/350; 108/92; 312/196

[58] Field of Search ..... 312/126, 348, 194, 195, 312/196, 350; 108/92, 102

[56] References Cited

U.S. PATENT DOCUMENTS

| | | | |
|---|---|---|---|
| 358,698 | 3/1887 | Schonacker | 108/92 |
| 1,270,496 | 6/1918 | Cimaglia | 312/330 R |
| 2,064,164 | 12/1936 | Ish | 108/102 |
| 2,251,544 | 8/1941 | Jiranek | 297/194 |
| 2,437,665 | 3/1948 | Rose | 108/102 |
| 2,524,909 | 10/1950 | Hines | 297/194 |
| 2,688,525 | 9/1954 | Lindstrom | 108/92 |
| 3,136,578 | 6/1964 | Tihovici | 297/194 |
| 3,554,625 | 1/1971 | Sly | 312/126 |
| 3,702,209 | 11/1972 | Moore | 312/196 |
| 3,834,325 | 9/1974 | Dewilde | 108/109 |

FOREIGN PATENT DOCUMENTS

| | | | |
|---|---|---|---|
| 2383631 | 11/1978 | France | 312/194 |

*Primary Examiner*—William E. Lyddane
*Assistant Examiner*—Joseph Falk
*Attorney, Agent, or Firm*—Shlesinger, Fitzsimmons & Shlesinger

[57] ABSTRACT

This cabinet has a plurality of vertically spaced, horizontally disposed, stationary shelves, which are closed at their rear ends and open at their forward ends. Slidably mounted between an adjacent pair of the stationary shelves is a movable, pull-out shelf, opposite sides of which are mounted on conventional roller brackets for movement between a retracted position in which the shelf is fully seated within the cabinet, and an extended position in which it projects horizontally from the front of the cabinet. The movable shelf is designed to simplify a cancelled check in-filing operation, and for that reason has a horizontally disposed, central recess for removably supporting thereon a check filing tray, and a pair of horizontally disposed, arm-supporting surfaces which are positioned adjacent opposite sides of the central recess. The arm-supporting surfaces lie in a common horizontal plane at conventional desk height, and are equi-spaced above the bottom of the recessed central surface a distance approximately equal to the height of a check filing tray. Two rectangularly shaped openings are formed in the front of the movable shelf beneath its arm-supporting surfaces for removably holding a pair of check filing trays.

3 Claims, 4 Drawing Figures

CHECK FILING CABINET

BACKGROUND OF THE INVENTION

This inventions relates to an improved system for filing cancelled checks, and more particularly to improved filing cabinet for use by banks in the filing and storage of cancelled checks.

Banks have long been troubled with the labor intensive job of sorting and filing their customers' cancelled checks. There are two general systems for filing such checks—namely, (1) a so-called bulk filing system in which the checks are stored in random fashion in open, shoe-box shaped containers or trays, and (2) an in-filing system in which the checks are likewise stored in shoe-box shaped trays, but in a predetermined sequence, for example in an account number sequence.

Heretofore most banks have utilized the in-filing system, which requires manual sequencing of the cancelled checks in the storage trays, so that if need be the checks for a given account can be readily retrieved.

With improved data processing systems more and more banks are planning, eventually, to rely upon computers for searching and recording cancelled check files. Once the checks have been recorded in the computer they can be bulk filed in no particular sequence. Most banks, however, have not as yet converted to a complete bulk filing system. There is, therefore, a need for supplying such banks with equipment which will tend to minimize labor costs otherwise incurred during in-filing operations of the type described, and yet which will be readily adaptable or convertable to bulk filing operations.

Accordingly, it is an object of this invention to provide an improved bulk-filing type storage cabinet which has incorporated therein a novel pull-out shelf, which is particularly designed for use by operators during in-filing operations.

A more specific object of this invention is to provide for a bulk filing cabinet of the type described a novel pull-out shelf which has a central, recessed working area for supporting a check holding tray, and a pair of horizontal surfaces adjacent opposite sides of the recessed area for supporting the arms of an operator during an in-filing operation.

Still another object of this invention is to provide for a cabinet of the type described a novel pull-out shelf having formed thereon a pair of spaced compartments which perform the dual purpose of providing arm rests and storage areas to check holding trays.

Other objects of the invention will be apparent hereinafter from the specification and from the recital of the appended claims, particularly when read in conjunction with the accompanying drawings.

SUMMARY OF THE INVENTION

A check filing cabinet is provided with a plurality of vertically spaced stationary shelves, and one, approximate waist-high pull-out shelf, which is supported at opposite sides thereof on the opposed side walls of the cabinet for limited horizontal reciprocation between a retracted position in which it is fully seated in the cabinet, and an extended position in which it projects at its forward end out of the cabinet.

The pull-out shelf has a flat base plate and a specially shaped upper surface defined by two, spaced, rectangularly shaped compartments which project upwardly from the base plate adjacent opposite sides thereof. The confronting sides of the two compartments form therebetween a rectangularly shaped recess designed to removably house a check filing tray, the upper, open end of which is disposed to be in a common, horizontal plane containing the flat, upper ends of the two compartments. An operator may then rest his or her arms on the flat tops of the compartments when the shelf has been drawn out to its extended, operative position; and the operator's hands will be free to manipulate the checks and account cards contained in the particular filing tray that is then located in the recess between the compartments.

The outer ends of the compartments are open so that each may releasably accommodate and store therein one of the check filing trays.

THE DRAWINGS

Figure 1:
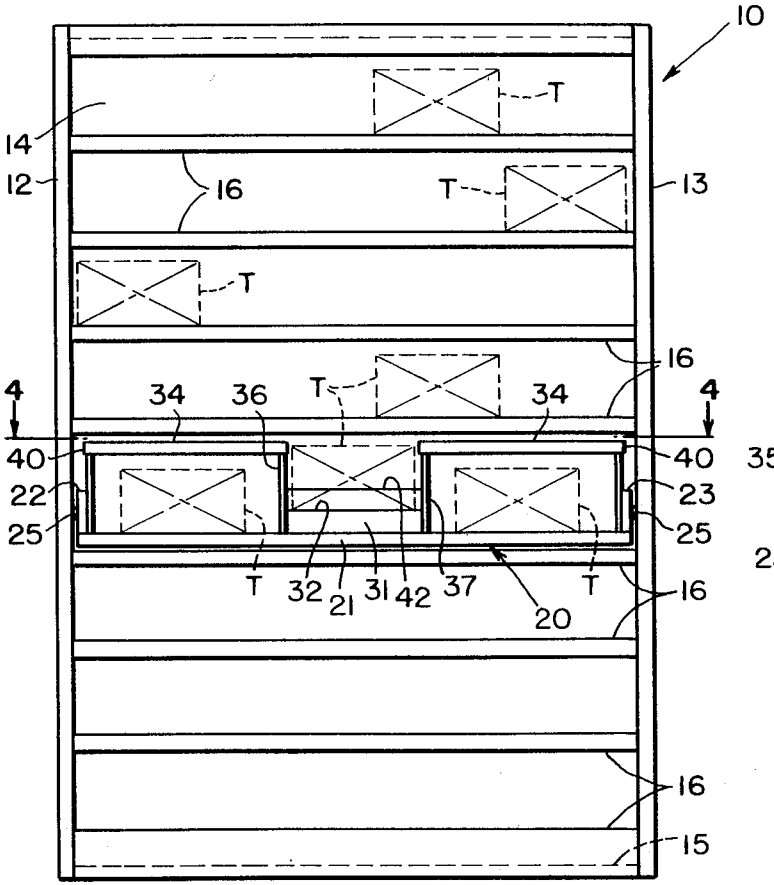
FIG. 1 is a front elevational view of an improved check filing cabinet made according to one embodiment of this invention and illustrating in phantom by broken lines a plurality of check filing trays which are shown to be stored in various locations in the cabinet and in the novel pull-out shelf which forms part of this cabinet.
Figure 3:
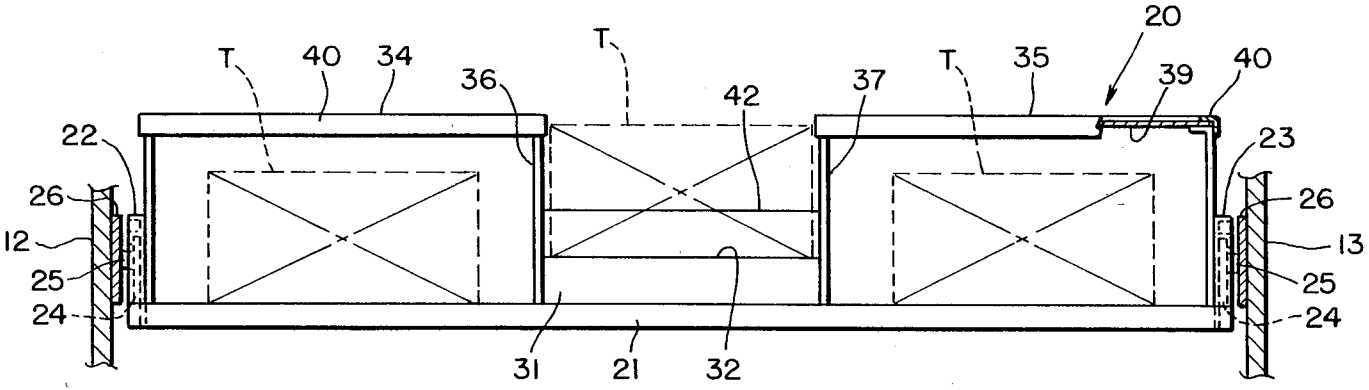
Figure 4:
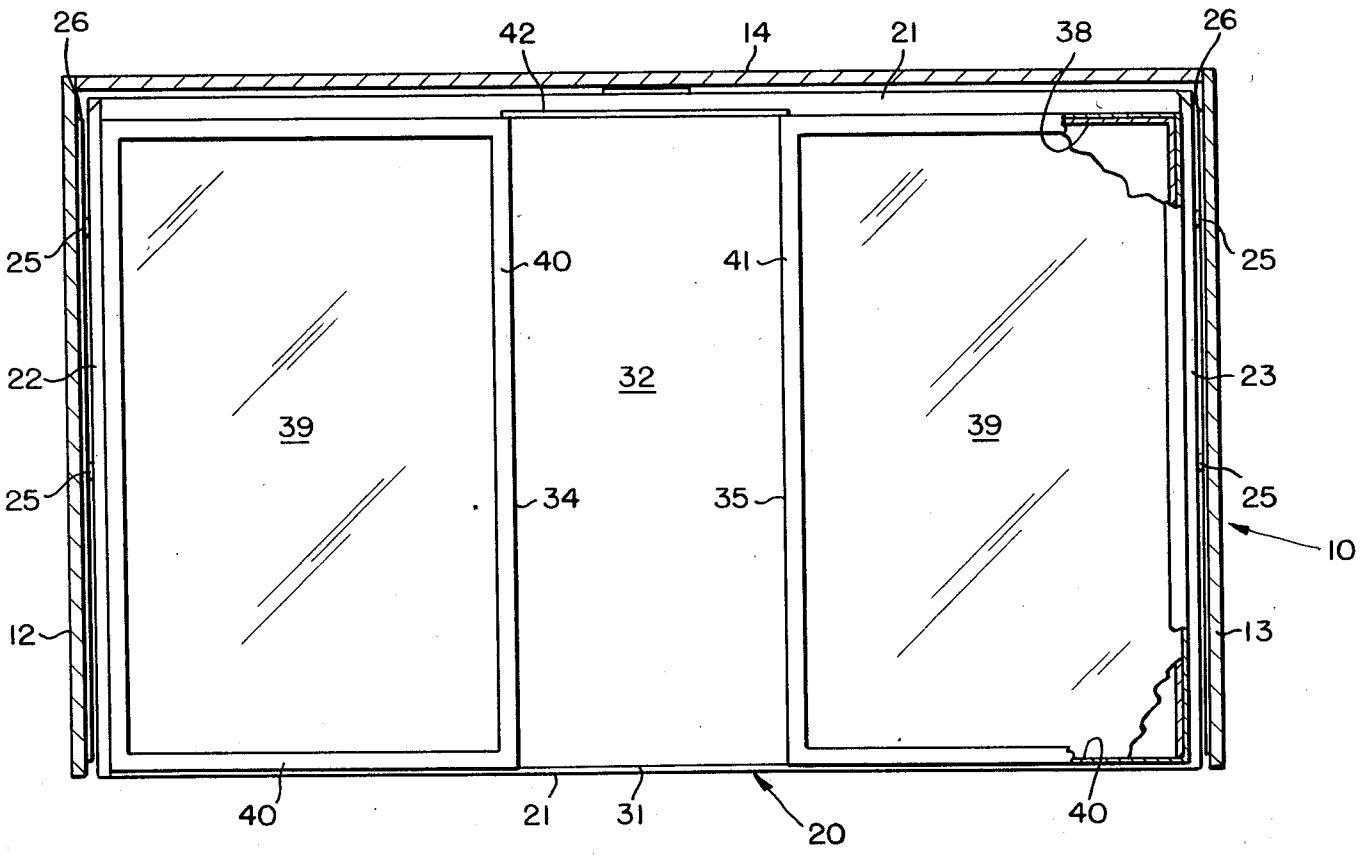

FIG. 3 is an enlarged, fragmentary front elevational view generally similar to FIG. 1, but showing in greater detail the cabinet's pull-out shelf, and with portions of the cabinet being broken away and shown in section for purposes of illustration; and FIG. 4 is an enlarged sectional view taken generally along the line 4—4 in FIG. 1 looking in the direction of the arrows, and with portions of the pull-out shelf being cut away and shown in section for purposes of illustration.

DETAILED DESCRIPTION OF THE PREFERRED EMBODIMENTS

Referring now to the drawings by numerals of reference, 10 denotes generally a storage cabinet comprising a pair of spaced, parallel side walls or panels 12 and 13, the rear edges of which are secured to the opposed side edges of a vertical back wall or panel 14, which extends at right angles between the side walls 12 and 13. Cabinet 10 has a horizontally disposed bottom wall 15, which is secured around its marginal edges to the lower edges of walls 12, 13 and 14, and a horizontal top wall or panel 16, which likewise is secured around its marginal edges to the upper ends of the walls 12–14. Cabinet 10 contains a plurality of stationary, generally equi-spaced, horizontally disposed shelves 16, which are secured around their marginal edges to confronting surfaces of the cabinet walls 12–14. The storage space above each shelf 16 is closed at its rear end by the back wall 14 of the cabinet, but is open or unobstructed at its forward end at the front of the cabinet.

As thus far described, cabinet 10 is conventional, and is designed to have releasably supported on its shelves 16 a plurality of conventional check filing or storage trays T, as shown for example in phantom by broken lines in FIGS. 1 and 3. These trays, which may be of the type shown for example in U.S. Pat. No. 4,133,444, are designed to hold a plurality of signature cards for respectively different bank accounts, and between adjacent cards, cancelled checks drawn on a given account.

During a so-called in-filing operation, a bank employee or the like, sorts through incoming cancelled checks, and separates them by their respective account numbers. The cancelled checks for a given account are then placed in the particular tray T which contains the signature card for that particular account, normally placing the cancelled checks either before or after the respective signature card, and in doing so comparing the signature on the check with the signature on the associated signature card. In this way cancelled checks are placed in the proper account at the same time that the signature of the check is verified. The account numbers contained in a respective tray T can be listed on the fronts of the trays to be readily visible to an operator facing the front of the cabinet 10.

To simplify this in-filing operation, cabinet 10 is provided with a specially shaped pull-out shelf, which is denoted generally at 20 in FIGS. 1–4. Shelf 20 is made for the most part from sheetmetal plate, which is fabricated to form a rigid, rectangularly shaped base or bottom plate 21 having spaced, parallel upstanding side walls 22 and 23. Secured to the outside of each of the two side walls 22 and 23 is a mounting bracket 24 (FIGS. 2 and 3), which forms part of a pair of conventional suspension mechanisms that are used to suspend shelf 20 from the cabinet side walls 12 and 13. These mechanisms which may be of the type known as the Knape and Vogt model KV1460, include the usual guide rollers 25 (FIGS. 1, 3 and 4), which are carried by the brackets 24 to project into registering ways formed in cooperating suspension brackets 26 (FIGS. 3 and 4), which are mounted on the inside surfaces of the cabinet side walls 12 and 13.

Since the above-noted suspension mechanims are conventional, they will not be described in further detail herein. However, it will be apparent to one skilled in the art that the rollers 25 and cooperating brackets 24, 26 support the shelf base 21 and the attached side walls 22, 23 for sliding, horizontal reciprocation relative to cabinet 10 between a retracted or inoperative position in which the shelf 20 is fully seated within the cabinet, as shown for example in FIG. 4, and an extended or operative position in which the shelf projects outwardly from the cabinet as shown in FIG. 2.

Secured on the upper surface of base 21 centrally thereof is a rectangularly shaped platform 31, opposite sides of which are equi-spaced from the shelf side walls 22 and 23, and the top of which forms on base 21 a raised, horizontally disposed working surface 32 that extends transversely between the front and rear edges of the base. Also secured on base 21 at opposite sides of the platform 31 are two rectangularly-shaped compartments 34 and 35, which have spaced, parallel, confronting side walls 36 and 37, respectively, which project equidistantly above and at right angles to the working surface 32 of platform 31, and which also extend transversely between the forward and rear edges of base 21 parallel to platform 31.

As shown more clearly in FIG. 4, each compartment 34 and 35 is closed at its back or rear end by a vertically extending wall 38, but is open at its outer or forward end so that a tray T can be removably stored therein as shown in FIGS. 1 and 3. Each compartment 34 and 35 is closed at its upper end by a rigid, rectangularly-shaped sheet or layer 39 (FIGS. 3 and 4) of formica, or the like. The sheets 39 are secured over the upper ends of the respective compartments 34 and 35 by rectangularly shaped bezels or molding strips 40, which have therein enlarged, rectangular, central openings which expose major portions of the upper surfaces of the formica layers 39 for purposes noted hereinafter.

Figure 2:
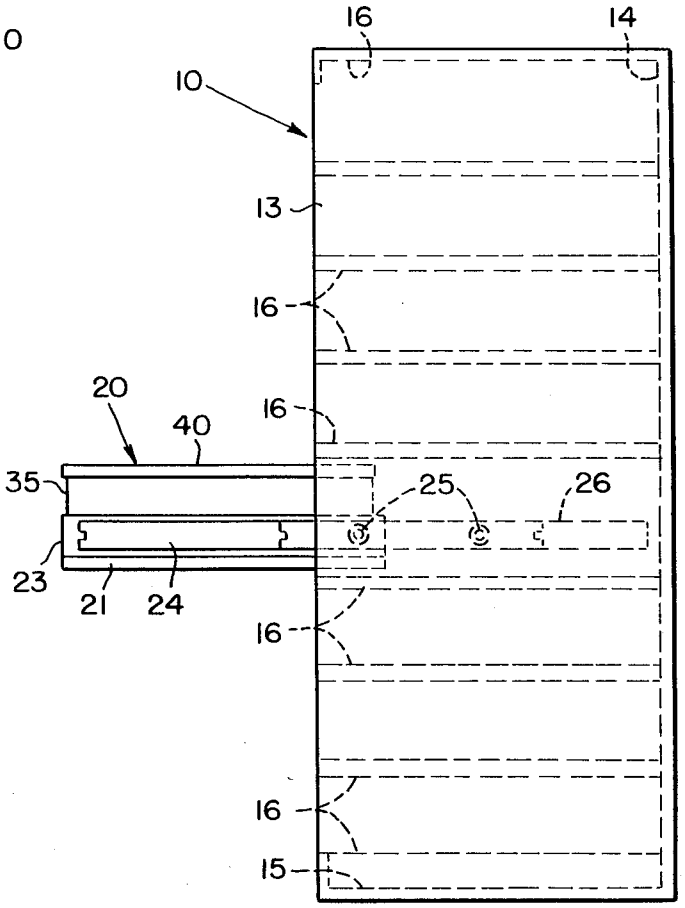
FIG. 2 is a side elevational view of this cabinet, but showing the pull-out shelf in its outer or extended position.

In use, shelf 20 may be pulled outwardly to its extended position as shown in FIG. 2, thus exposing the upper surfaces of the platform 31 and the two formica layers 39. As shown more clearly in FIGS. 1 and 3, the spaced compartment side walls 36 and 37 cooperate with the platform surface 32 to provide a rectangular recess just wide enough to accommodate a tray T. Moreover, the two formica layers 39 are positioned in a common horizontal plane spaced above the upper surface 32 of platform 31 a distance approximately equal to the height of a tray T. The shelf 20 is positioned in the cabinet 10 in such manner that a chair, if desired, can be placed beneath the shelf so that an operator can sit and place his or her arms comfortably on the formica surfaces 39, whereby during an in-filing operation the operator's hands can readily manipulate the cards or checks contained in the particular tray T, disposed on the operating surface 32. During this time, of course, additional trays T can be stored in the side compartments 34 and 35.

When not in use, the shelf 20 can be shifted back into its retracted position in which it is fully seated within the cabinet 10. Even in this position, however, trays T can be stored in the respective compartments 34 and 35, as well as upon the platform 31, whereby shelf 20 does not materially reduce storage capacity of the cabinet 10. For this reason the cabinet is readily adaptable either to storing checks in bulk form and/or checks which have been filed in accordance with the in-filing method—i.e. by account number.

To prevent a tray T disposed on the working surface 32 from sliding rearwardly on the platform 31, a strap 42 (FIGS. 1, 3 and 4) is fastened at opposite ends to the backs of the compartments 34, 35 to project at right angles upwardly from the operating surface 32 to form a back rest or stop for the tray T disposed on the platform.

From the foregoing it will be apparent that the present invention provides a relatively simple and inexpensive means for simplifying the in-filing of cancelled checks. By incorporating a novel shelf 20 in a bulk filing storage cabinet, the cabinet then has the versatility of being suitable for use both for the bulk filing or the in-filing of cancelled checks. The pull-out shelf 20 does not materially reduce the overall capacity of a conventional filing cabinet, yet does provide a relatively compact and efficient means for expediting the in-filing of checks in conventional storage trays T.

While it has been suggested that formica may be used for the compartment tops 39, it will be apparent that any similar material may be employed for these arm supports. Moreover, while this invention has been described in detail in connection with only certain embodiments thereof, it will be apparent that it is intended to cover any additional modifications which may fall within the scope of one skilled in the art or the appended claims.

What we claim is:

1. In a check filing cabinet including a frame having a pair of spaced, parallel side walls, and a plurality of vertically spaced, stationary shelves secured to and extending transversely between said side walls, and disposed releasably to support check-holding trays thereon, and a movable shelf mounted on said frame between a pair of said stationary shelves for limited horizontal sliding movement between an extended position in which it projects part way from the front face of said cabinet, and a retracted position in which it is fully seated in said cabinet with its forward edge registering approximately with the front face of said cabinet, said movable shelf having thereon a first, centrally disposed, plane operating surface that extends horizontally rearwardly from a straight portion of the forward edge of the movable shelf at least part way toward the rear edge thereof, and disposed releasably to support thereon a single one of said trays, the improvement comprising means forming a pair of spaced, horizontally disposed, arm-supporting surfaces located adjacent opposite sides, respectively, of said plane operating surface and equispaced thereabove a predetermined distance equal approximately to the height of said one tray thereby to line in a common horizontal plane which registers with the upper end of the tray disposed on said operating surface, said forming means comprising a pair of laterally spaced housings formed on top of said movable shelf adjacent the opposed side edges thereof, and flanking opposite sides, respectively, of said plane operating surface, said housings projecting said predetermined distance above said operating surface, and being closed at their upper ends by coplanar top walls which define said spaced, arm-supporting surfaces, and said housings and said plane operating surface being movable horizontally with said movable shelf between retracted positions within said cabinet and extended positions in which they also project from the front face of said cabinet, when the movable shelf is in its extended position.

2. A cabinet as defined in claim 1, wherein said housings are adapted each to releasably house one of said trays, and are generally rectangular in configuration and have open forward ends facing said front face of said cabinet, and closed rear ends confronting upon the rear face of said cabinet.

3. A cabinet as defined in claim 1, wherein said housings are generally rectangular in configuration and have spaced parallel side walls two of which extend for approximately said predetermined distance vertically above said operating surface adjacent opposite sides thereof, thereby to form in the top of said movable shelf between said housings, and above said operating surface, a recess which is rectangular in cross seciton, and which extends from the front edge of said movable shelf toward the rear thereof.

* * * * *